US005937693A

United States Patent [19]

Endou et al.

[11] Patent Number: 5,937,693

[45] Date of Patent: Aug. 17, 1999

[54] TRANSFER APPARATUS OF PRESS

[75] Inventors: Kenichi Endou; Hideo Itakura, both of Sagamihara, Japan

[73] Assignee: Aida Engineering Ltd., Kanagawa, Japan

[21] Appl. No.: 08/691,869

[22] Filed: Aug. 2, 1996

[30] Foreign Application Priority Data

Dec. 6, 1995 [JP] Japan ..... 7-344935

[51] Int. Cl.[6] ..... B21D 43/05

[52] U.S. Cl. ..... 72/405.16; 72/405.12; 198/621.1; 470/109; 470/154

[58] Field of Search ..... 72/405.16, 405.11–405.13, 72/405.09, 405.08, 405.01; 470/95, 109, 154; 198/621.1

[56] References Cited

U.S. PATENT DOCUMENTS

| | | | |
|---|---|---|---|
| 3,937,056 | 2/1976 | Henzler | 72/405.11 |
| 4,272,981 | 6/1981 | Endter | 72/405.12 |
| 4,463,587 | 8/1984 | Werner | 72/405.12 |
| 4,540,087 | 9/1985 | Mizumoto | 72/405.16 |
| 4,604,021 | 8/1986 | Werner | 72/405.12 |
| 4,621,516 | 11/1986 | Schafer | 72/405.12 |
| 5,423,202 | 6/1995 | Komatsu | 72/405.16 |
| 5,617,756 | 4/1997 | Thudium | 72/405.16 |

FOREIGN PATENT DOCUMENTS

| | | | |
|---|---|---|---|
| 175803 | 10/1965 | U.S.S.R. | 72/405.09 |

*Primary Examiner*—Daniel C. Crane

*Attorney, Agent, or Firm*—Wood, Phillips, VanSanten, Clark & Mortimer

[57] ABSTRACT

A transfer apparatus for use in a press in which successive workpieces are sequentially transferred from one to the next of a plurality of working stages arranged along a line. The transfer apparatus has a transfer bar having a plurality of workpiece holding devices such as air chucks each being capable of holding and releasing the workpiece, and a driving unit provided at the rear side of the press. The driving unit has advance/return mechanism having a first servo-motor and a rack-pinion mechanism which cooperate in driving the transfer bar in advance and return directions, a lift/down mechanism having a second servo-motor and a rack-pinion mechanism which cooperate in driving the transfer bar in lift and down directions, and an approach/retract device having a third servo-motor and a rack-pinion mechanism which cooperate in driving the transfer bar in approaching and retracting directions, so that successive workpieces are transferred from one to the next working stages of the press so as to undergo a series of steps of press work. Dies and workpieces are easily observed during the press working and efficiency of die exchanging work is improved because the driving unit is disposed on the rear side of the press.

2 Claims, 5 Drawing Sheets

TRANSFER APPARATUS OF PRESS

BACKGROUND OF THE INVENTION

1. Field of the Invention

The present invention broadly relates to a press having a plurality of working stages arranged along a straight line and, more particularly, to a transfer apparatus for successively and sequentially transferring workpieces to the working stages of the press.

2. Description of the Related Art

A conventional transfer apparatus of the kind described has a pair of feed bars which are driven by a driving unit provided at one side of the press so as to sequentially perform a series of motions including advance/return, clamp/unclamp and lift/down so that each of successive workpieces is clamped, advanced and unclamped so as to be transferred from one to the next working stage. Thus, the operation relies upon simple clamping and unclamping operation for holding and releasing the workpieces, thus offering high production efficiency. This type of transfer apparatus, however, poses a problem in that it hinders the operator's sight so as to impair visibility of the workpiece and die during press working of the workpiece. In addition, the transfer apparatus of this type hampers the efficiency of the die exchanging work.

Another known transfer apparatus employs a single transfer bar having a work clamping/unclamping unit and adapted to be driven by a driving unit provided at one side of the press so as to perform advance/return and lift/down motions, thereby sequentially transferring successive workpieces. This type of transfer apparatus, although it offers improved die visibility and higher efficiency of die exchanging work, poses another problem kin that the throughput is lowered. Namely, since the transfer bar does not move towards and away from the work, the press operation has to be suspended until the work holding device on the transfer bar is moved to a position between adjacent dies, in order to avoid interference between the work holding device and the dies.

A transfer system also has been proposed in which workpieces are successively transferred by an industrial robot which is situated in front of the press. Simultaneous transfer of a plurality of workpieces by such an industrial robot, however, requires a complicated motion to be performed by the robot and, hence, longer cycle time, as well as raised costs of installation.

SUMMARY OF THE INVENTION

Accordingly, an object of the present invention is to provide a transfer apparatus of a press which improves production efficiency, as well as die visibility during press operation and efficiency of die exchanging work, thereby overcoming the above-described problems of the known transfer apparatuses.

According to the present invention, a transfer apparatus has a single transfer bar carrying a plurality of workpiece holding devices each being operable to clamp and unclamp workpieces to be press-worked. The single transfer bar is driven by a driving unit so as to perform advance/return, lift/down and approach/retract motions. The driving unit for driving the single transfer bar is disposed at the rear side of the press. The single transfer bar transfers each workpiece from one to the next working stages. The stroke of the advance/return motion of the transfer bar is determined to be equal to the pitch at which the dies of the plurality of working stages are arranged, i.e., the distance between adjacent dies, so that the workpiece is transferred from the die of one working stage to the die of the next working stages. Alternatively, the stroke of the advance/return motion is set to be half the pitch of the dies and an idle stage is provided between each two adjacent dies, so that each workpiece is transferred from a die to an adjacent idle stage while the preceding workpiece is transferred from the idle stage to the die of the next working stage, whereby successive workpieces are transferred through a series of working stages so as to be formed into a product part.

According to this arrangement, visibility of the dies during press working, as well a efficiency of the die exchanging work, is improved by virtue of the fact that the driving unit and the transfer bar are disposed behind the press. In addition, since the stroke of the advance/return motion of the transfer bar may be as small as half the pitch of arrangement of the dies, transfer of the workpieces can be stabilized to ensure higher production efficiency.

The above and other objects, features and advantages of the present invention will become clear from the following description of the preferred embodiments when the same is read in conjunction with the accompanying drawings.

DESCRIPTION OF THE PREFERRED EMBODIMENTS

An embodiment of the present invention will be described with reference to FIGS. 1 to 5.

Figure 1:
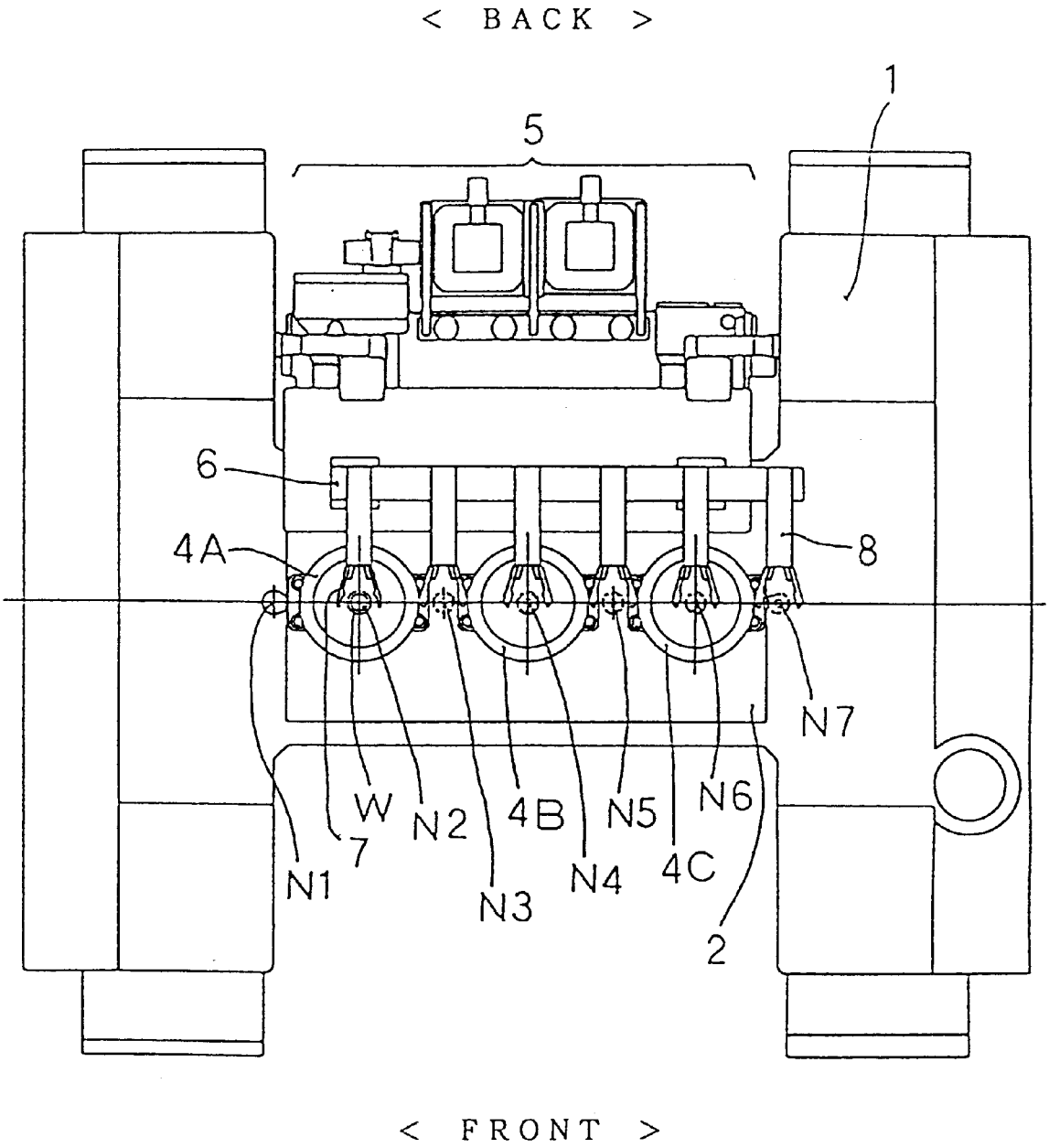
FIG. 1 is a top plan view of a major part of a press in accordance with the present invention.
Figure 2:
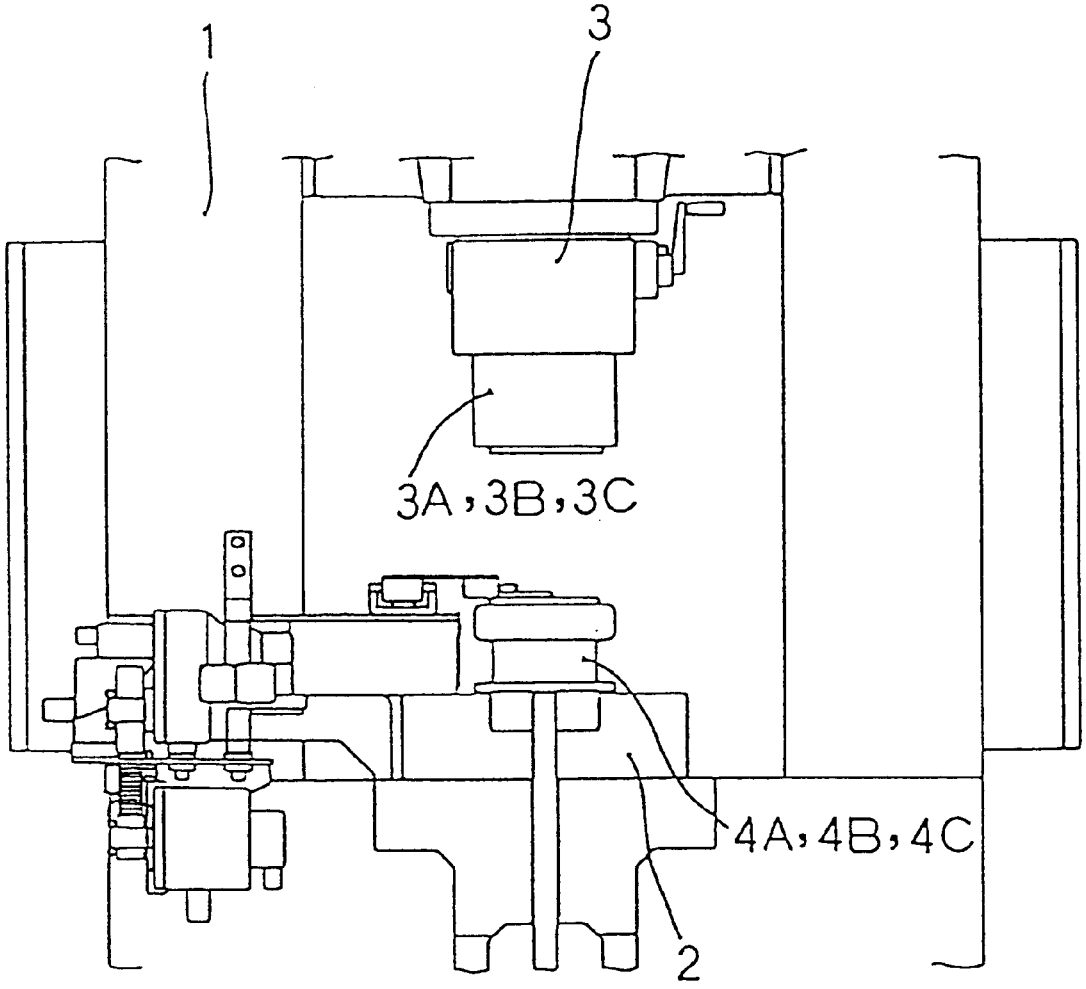
FIG. 2 is a sectional view of the press as viewed from the right side thereof.

As will be seen from FIGS. 1 and 2, a driving unit 5 is disposed at the rear side of a press which is generally denoted by 1. The press 1 has idle stages N1, N3, N5 and N7 and working stages N2, N4 and N6.

A workpiece W are fed one by one by a workpiece feeder (not shown) to an idle stage N1 and then to the working stage N2 and further to stages N2, N3 onwards to the final stage N7, by means of a plurality of work holding devices 7 which are carried by a transfer bar 6.

Figure 3:
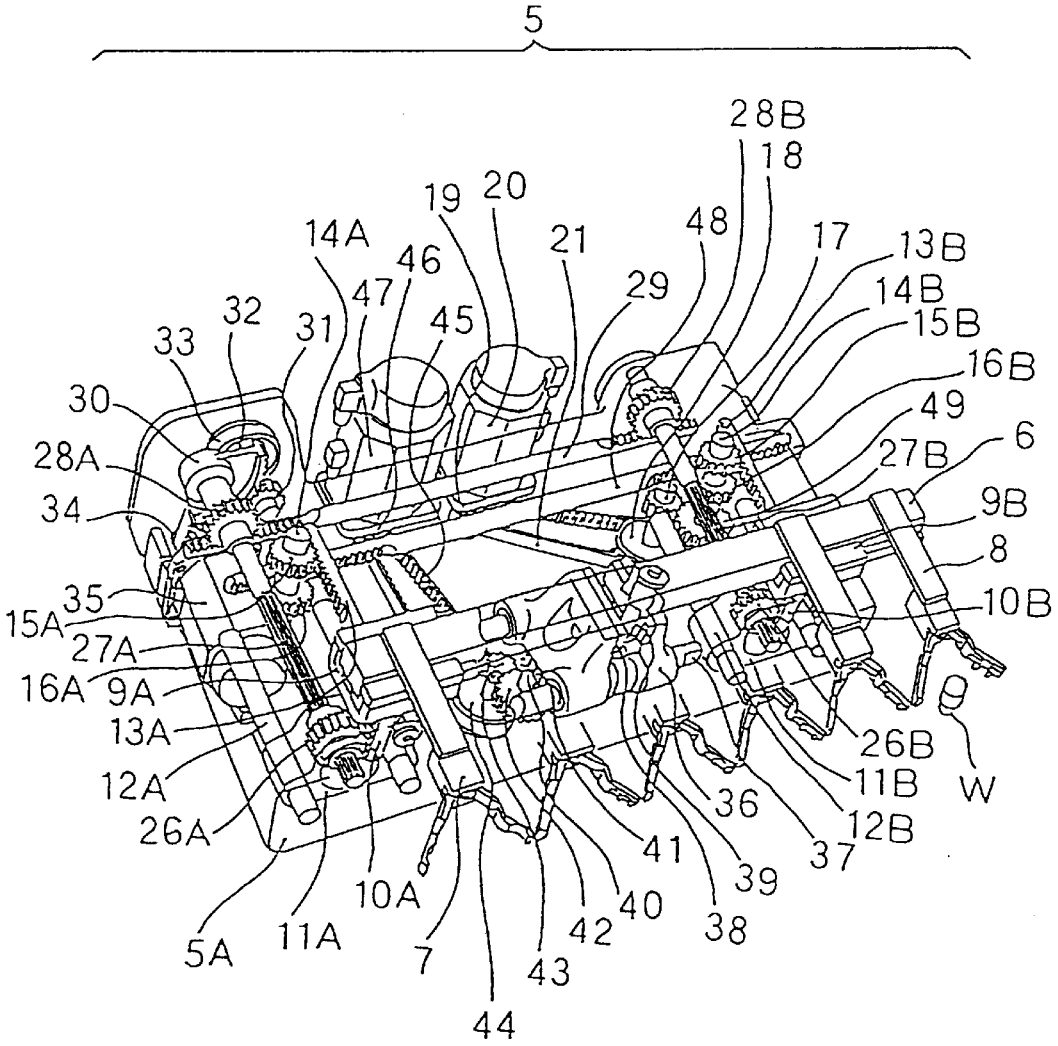
FIG. 3 is a perspective view of a transfer apparatus embodying the present invention.

The transfer bar 6 is disposed so as to extend in the direction of advance of the workpiece W and is slidably supported and guided by a pair of guides 9A, 9B so as to be driven in the advance/return directions by the driving unit 5 the detail of which is shown in FIG. 3.

A plurality of finger plates 8 each having at its one end with the work holding device 7 are attached to the upper side of the transfer bar 6. In this embodiment, an air chuck with fingers is used as the work holding device 7. The fingers are moved towards and away from each other at a predetermined timing so as to clamp and unclamp the workpiece W. Although the illustrated embodiment employs an air chuck with fingers as the work holding device 7, other suitable means such as a vacuum suction cup, a solenoid magnet or the like may be used as the work holding device 7. Racks 10A, 10B are fixed to lower portions of the holders 9A, 9B and are slidably secured to carts 11A, 11B so as to be slidable on these carts in the lift/down directions. The carts 11A, 11B are slidably secured to guide rods 12A, 12B fixed to a unit case 5A of the driving unit 5, so as to be slidable in approach/retract directions.

The operation of the transfer bar is as follows.

The approach/retract motion of the transfer bar 6 is caused by push/pull operation of racks 13A, 13B provided on the carts 11A, 11B.

There is a pair of equalizer shafts 14A, 14B. The equalizer shaft 14A has a first pinion 15A and a second pinion 16A which are coaxial with each other. Similarly, the equalizer shaft 14B has coaxial first and second pinions 15B, 16B. The racks 13A, 13B engage with the first pinions 15A, 15B, respectively, while the second pinions 16A, 16B mesh with racks which are provided on both ends of an equalizer rod 48. A drive pinion 17 engaging with a drive gear 49 on the equalizer shaft 14B has a coaxial pulley 18 and is drivingly connected through a belt 21 to a pulley 19 which is provided on the output shaft of a servo-motor 20, whereby the drive pinion 17 is driven by the servo-motor 20.

The arrangement is such that forward and backward rotations of the drive shaft 16 driven by the servo-motor 20 causes approaching and retracting motions of the transfer bar 6.

The lift/down motion of the transfer bar 6 is performed as follows. Pinions 26A, 26B rotatably mounted on the carts 11A, 11B are driven so that the racks 10A, 10B engaging with the pinions 26A, 26B are moved up and down, thus causing lift/down motion of the guides 9A, 9B and, hence, of the transfer bar 6. Spline shafts 27A, 27B rotatably secured to the unit case 5A are held in engagement with the pinions 26A, 26B in such a manner that relative movement is allowed between these spline shafts 27A, 27B and the pinions 26A, 26B in the direction of the approach/retract motion. Drive pinions 28A, 28B fixed to these spline shafts 27A, 27B are held in engagement with the racks provided on both ends of the equalizer rod 29. A drive pinion 31, which engages with a sector gear 30 provide don an end of the spline shaft 27A, has a pulley which is coaxial therewith and is driven by a servo-motor 35 through a belt 33 which is stretched between the pulley 32 and a pulley 34 provided on the output shaft of the servo-motor 35.

More specifically, forward or backward rotation of the drive pinion 32 driven by the servo-motor 35 causes a lift or down motion of the transfer bar 6, through the operations of the spline shafts 27A, 27B, pinions 26A, 26B and racks 10A, 10B.

Advance/return motion of the transfer bar 6 is caused by a reciprocatory sliding motion a slide pin 39 in the advance and return directions The slide pin 39 being provided on an upper part of the cart 36 guided by a guide rod 37 fixed to a unit case 5A. The slide pin 39 is fixed to the transfer bar 7 and is clamped between a pair of push plates.

A rack 41 meshing with a pinion 40 is attached to the lower side of the cart 36 so as to extend in the direction of the advance/return motion. A drive gear 42 is fixed to the pinion 40 coaxially therewith and is held in engagement with a drive pinion 43 which has a coaxial pulley 44. The pulley 44 is driven through a belt 45 by a servo-motor 47 having a pulley 46 on the output shaft thereof.

Thus, the transfer bar 6 performs advance and return motions as the drive gear 42 is driven forward and backward by the servo-motor 47.

Figure 4:
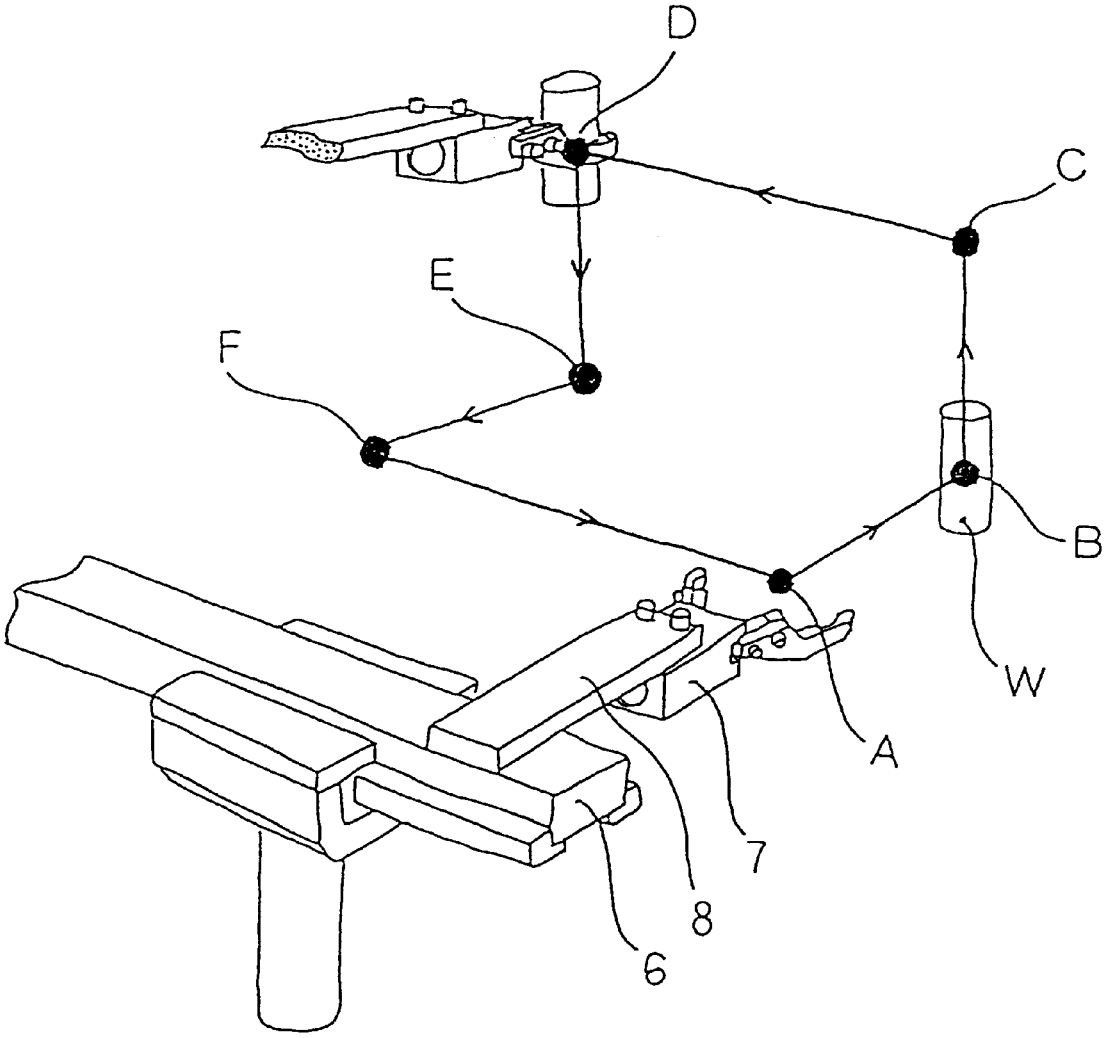
FIG. 4 is an illustration of the principle of operation of the transfer apparatus.

The sequence of motions of a slide in the press having the described construction will be described with specific reference to FIG. 4.

The transfer 6 has been fully returned, fully retracted and fully moved down so as to be set at an initial stand-by position (point A). The transfer bar 6 then moves to an approaching stroke end (point B) in order to enable the workpiece holding devices 7 to hold the works which are on the working stages N2, N4, N6 or the idle stages N1, N3, N5 of the press 1. After the workpieces W have been held by the holding devices 7, the transfer bar 6 is moved to the end of the lifting stroke (point C). The transfer bar 6 is then advanced to an advance stroke end (point D) and further moved down to the down stroke end (point E), whereby each workpiece is conveyed to the next stage. Then, the work holding devices unclamp the workpieces W to deliver them to the respective stages, and the transfer bar 6 is fully retracted to the retract stroke end (point F). The press 1 then operates so that the workpieces undergo respective steps of press work. In the meantime, the transfer bar 6 is returned to the initial stand-by position (point A).

Figure 5:
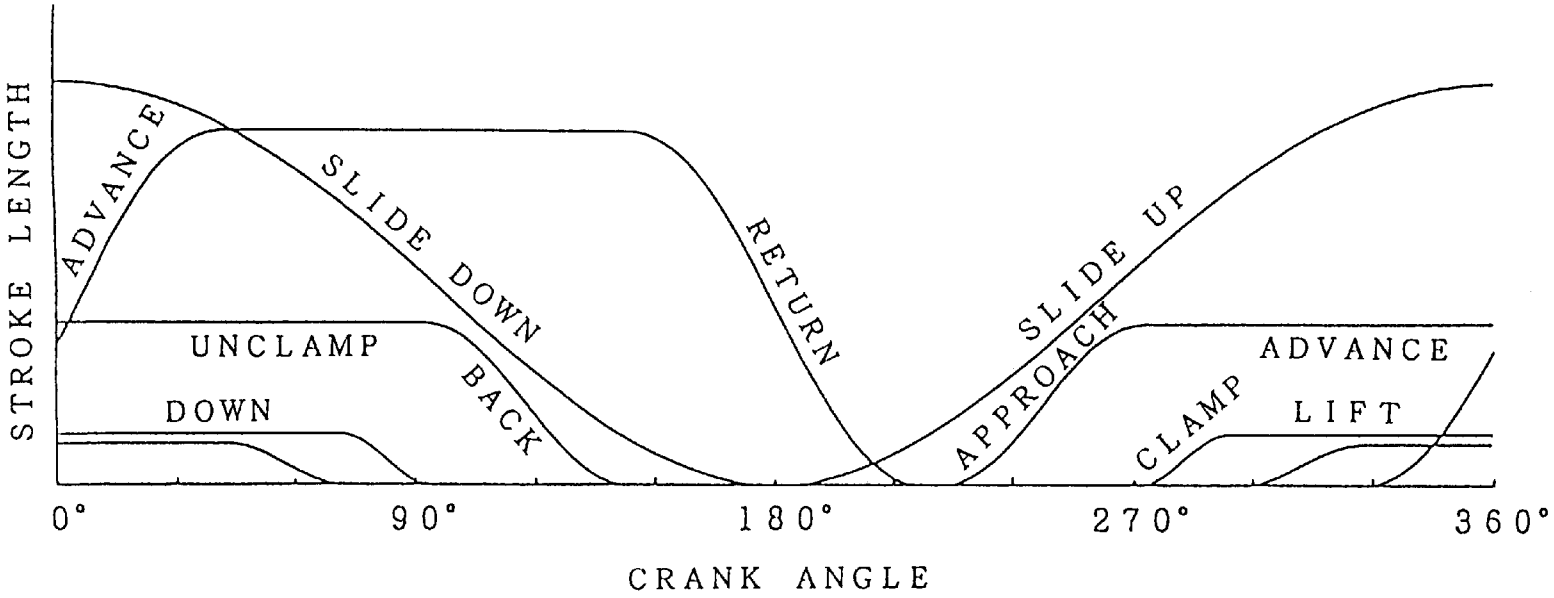
FIG. 5 is a timing chart illustrative of the operation timing of the transfer apparatus in relation to the operation of the press.

The transfer bar 6 repeats the described motions at timings shown by the timing chart in FIG. 5, whereby the successive workpieces W are transferred from one to the next of the stages N1, N2, N3, N4, N5, N6 and finally to N7.

In this embodiment, the workpieces W are shifted from the left to the right by a distance which equals to half the pitch at which the dies of the successive working stages are disposed, so that the workpieces W are sequentially and successively delivered to the lower dies 4A, 4B and 4C provided on the die plate 2, whereby the workpieces W undergo the successive steps of press work. Obviously, the length or distance of the advance/return motion may be set to be equal to the pitch of arrangement of the dies. The workpiece W which has undergone the final step of the press work is taken out form the work output stage N7 of the press 1 by a product pickup device (not shown).

The sequence of the motions in each cycle of operation of the slide of the press can be set and changed as desired by suitably setting numerical values in the controller for controlling the servo-motors 20, 37 and 47, and/or changing the setting of the signals for operating the work holding devices 7. It is also possible to vary the stroke length of each motion, as well as velocity of the transfer bar in each motion.

What is claimed is:

1. A transfer apparatus for use in a press in which successive workpieces are sequentially transferred from one to the next of a plurality of working stages arranged along a line, comprising:

a transfer bar having a plurality of workpiece holding devices each being capable of holding and releasing said workpiece; and a driving unit provided at the rear side of said press, said driving unit comprising advance/return means having a first servo-motor and a rack-pinion mechanism which cooperate in driving said transfer bar in advance and return directions; lift/down means having a second servo-motor and a rack-pinion mechanism which cooperate in driving said transfer bar in lift and down directions; and approach/retract means having a third servo-motor and a rack-pinion mechanism which cooperate in driving said transfer bar in approaching and retracting directions.

2. A transfer apparatus according to claim 1, wherein said press has an idle stage at a position midway two adjacent dies, and wherein said driving unit sets the stroke length of advance motion of said transfer bar to a value which is half the pitch at which said dies are arranged, so that each said workpiece is transferred sequentially from a working stage to an idle stage and then to the next working stage.

* * * * *